US005234370A

United States Patent [19]

Shapero et al.

[11] Patent Number: 5,234,370

[45] Date of Patent: Aug. 10, 1993

[54] POSABLE DOLL HAIR AND METHOD OF MANUFACTURE FOR THE SAME

[75] Inventors: Wallace Shapero, West Hills; John Sneddon, Santa Monica, both of Calif.

[73] Assignee: Mattel, Inc., El Segundo, Calif.

[21] Appl. No.: 782,217

[22] Filed: Oct. 24, 1991

[51] Int. Cl.[5] ..... A63H 3/44; A41G 3/00

[52] U.S. Cl. ..... 446/394; 446/385; 428/16; 428/542.2; 132/53

[58] Field of Search ..... 446/394, 385, 296, 319, 446/372; 428/15, 16, 542.2; 132/201, 53, 56

[56] References Cited

U.S. PATENT DOCUMENTS

| | | | |
|---|---|---|---|
| 2,517,349 | 8/1950 | Raditz . | |
| 3,433,235 | 3/1969 | Doolittle | 132/53 |
| 3,614,843 | 10/1971 | Hawtin et al. | 446/394 |
| 3,750,682 | 8/1973 | Bonafiglia et al. | 132/53 |
| 3,852,152 | 12/1974 | Werner et al. | 428/338 |
| 3,910,291 | 10/1975 | Kim | 132/53 |
| 3,955,587 | 5/1976 | Dunn et al. | 132/53 |
| 4,302,491 | 11/1981 | Papageorgiou | 428/15 |
| 5,083,967 | 1/1992 | Yokoe et al. | 132/53 X |

*Primary Examiner*—Mickey Yu
*Attorney, Agent, or Firm*—Ray A. Ekstrand

[57] ABSTRACT

A doll supports a quantity of rooted hair fabricated to provide a posable or cold setting characteristic. The posable hair is formed of an amorphous thermoplastic material preferably having a high molecular weight in a compound including plasticizers, heat stabilizers and lubricants. The material is formed to provide a combination of glass transition temperature characteristic and hardness to produce the cold setting or posable quality.

7 Claims, 2 Drawing Sheets

POSABLE DOLL HAIR AND METHOD OF MANUFACTURE FOR THE SAME

FIELD OF THE INVENTION

This invention relates generally to dolls having synthetic hair and particularly to dolls in which the hair is curled, crimped or set.

BACKGROUND OF THE INVENTION

The majority of dolls manufactured through the years have provided some type of artificial or simulated hair to enhance the realism and play appeal thereof. In the most common type of doll hair used in recent years, a plurality of thin filaments formed from materials such as polypropylene nylon or spun saran are grouped into bundles of approximately ten to forty filaments each to form a "yarn" which is then rooted within the doll head in a highly automated process in which the yarn bundles are secured at spaced intervals to the doll's head in a fixed attachment. Typically, the machinery which performs the rooting operation also cuts the yarn at the desired length to provide the appearance of typical human hair. In general, the filaments used in artificial doll hair have diameters of approximately one to three one thousandths of an inch with the diameter being selected in accordance with the economic and appearance factors considered by the manufacturer.

In most dolls it is desired that in addition to rooting a head of hair, the hair be given some styling or curling for enhanced appearances. The typical materials mentioned above may be curled by the manufacturer prior to purchase using heat setting curling factors which impart a more or less "permanent" curl or style to the hair filaments. While the methods and parameters of such heat setting are, to some extent, a matter of manufacturer's choice, generally speaking the manufacturer uses one or more heated mandrels upon which the hair is wound and thereafter heated above the material's glass transition temperature. Typical temperatures for the materials most commonly used are approximately one hundred and ninety to two hundred degrees Fahrenheit. The hair is then cooled while on the mandrel to permit the material to retain its established curl or set afterwhich the mandrels are removed and the hair styling is completed by careful manipulation. Such artificial hairs of the materials typically used may, in some instances, be set or styled using setting gels in which the chemical properties of the hair are altered temporarily by the application of setting gel to groups of hair fiber wound about styling mandrels or the like. Thereafter, the hair dries and retains its newly acquired set.

The problem with the commercially available hair fibers and methods of styling and setting used therein is that they are very intolerant of further use and manipulation by the child user such as combing, brushing, resetting and similar anticipated play patterns. Most presently available hair materials once set are not easily combed to a straight condition or "combed out" and instead often become brittle, broke and, in some cases, matted or tangled. Once combing or brushing is accomplished notwithstanding the accompanying hair damage, it is not susceptible to restyling or recurling without the reapplication of heated mandrels or setting gels. In general, manufacturers and consumer groups have considerable objection to doll playsets which require heated mandrels or curling irons or sometimes caustic and unpleasant setting gels being placed in hands of young children. As a result, very little if any success has been realized in providing realistic synthetic hair for dolls which facilitates repeated comb-outs and restyling in a satisfactory, safe and convenient manner.

Faced with need for restylable combable artificial hair, practitioners in the art have attempted various processes and compositions with very little success thus far. It has been found that attempts to crimp and curl a variety of thermal plastic polymers of the type available from conventional melt spin processes have been unsuccessful due to the limited number of polymers which can be successfully manufactured by melt spinning to fibers resembling human hair. Certain amorphous polyester polymers are capable of melt spin manufacture but have, when subjected to styling and manipulation, been found unsatisfactory upon repeated stressing and have suffered breakage and created a "frizzled" appearance due to the irreversible deformation caused by attempts to style and comb-out the doll hair.

Another approach tried by practitioners in the art has involved the use of plastic coated thin wire either alone or in combination with conventional hair fibers. While the plastic coated wire provides the malleability and "posability" desired, it has a generally short life and becomes quickly broken when repeatedly bent during styling. In addition, such plastic coated wire hair generally is subject to combing difficulties and becomes tangled, matted, broken or simply cannot be combed after several hairstyles or sets have been imposed.

The need for evermore improved play friendly and more usable synthetic hair for dolls has prompted practitioners in the art to attempt a number of approaches. For example, U.S. Pat. No. 3,955,587 issued to Dunn, et al. sets forth a CHANGEABLE SHAPE HAIR PIECE AND METHOD OF STYLING AN ARTIFICIAL COIFFURE in which a plurality of ductile filaments such as 37 to 43 gage plastic coated wire are distributed throughout hair filaments in a manner such that a small number of such ductile filaments may provide a setting or holding force to influence a large number of standard synthetic hair filaments. The hairstyle of the doll may then be reshaped by deforming the standard hair and ductile filaments using manipulation tools similar to hair rollers and the like.

U.S. Pat. No. 3,750,682 issued to Bonafiglia, et al. sets forth HAIR PIECES, WIG AND LIKE PRODUCTS which are formed having the predominant hair simulating fiber formed of a blend of nylon-6 and polyalkyl methacrylate which is formed into a filamentary material and used to form a wig or the like.

U.S. Pat. No. 3,614,843 issued to Hawtin, et al. sets forth ARTIFICIAL HAIR for use in a hair piece comprising a plurality of filaments of synthetic or regenerated polymeric material such as cellulose triacetate formed in filaments having hollow interior construction as either ring or open ring cross sections.

U.S. Pat. No. 3,433,235 issued to Doolittle sets forth a DECORATIVE FEMALE HAIR PIECE in which a plurality of malleable tongues are secured to a base member in a replaceable attachment. Each hair tongue is surrounded by a plurality of synthetic fibers and retains the shape of the malleable tongue to permit styling thereof.

U.S. Pat. No. 3,910,291 issued to Kim sets forth an ARTIFICIAL HAIR AND METHOD FOR MANUFACTURING THE SAME for use in wigs and the like comprising a multiplicity of synthetic fibrous yarns each formed with a plurality of small waves having various sizes and extending in various directions. Also, set forth is a method for manufacturing such artificial hair which includes the steps of forming and treating the synthetic fibrous yarns to create the small waves thereon.

U.S. Pat. No. 4,302,491 issued to Papageorgiou sets forth a HAIR SIMULATING FIBER formed of a composite which includes a metallic core member coated with a plastic material to form a fine strand. The core member and/or the coating member may be flattened to provide a strand which will exhibit curling characteristics and may be readily styled by an operator.

U.S. Pat. No. 2,517,349 issued to Raditz sets forth an ARTIFICIAL MUSTACHE CONSTRUCTION in which a synthetic mustache includes a pair of elongated malleable metal frames extending outwardly from the center portion of the fiber bundle to provide a malleable support for each half of the artificial mustache.

The foregoing described prior art synthetic hair fabrications and methods have enjoyed limited success and have not, to date, provided the highly desirable characteristics of a posable or cold set synthetic hair fiber suitable for use in dolls or the like. There remains, therefore, a continuing need in the art for evermore improved and more realistic synthetic hair fibers for doll hair which facilitate and tolerate repeated setting and combing out without becoming matted, tangled, brittle or broken.

SUMMARY OF THE INVENTION

Accordingly, it is a general object of the present invention to provide an improved synthetic hair for use in dolls and the like. It is a more particular object of the present invention to provide a doll having posable hair which may be repeatedly styled and combed out. It is a still more particular object of the present invention to provide an improved posable doll hair and method of manufacture for the same which may be posed or cold set by a child user.

In accordance with the present invention, there is provided a posable hair doll comprises: a doll head having a hair-supporting portion thereon; and a plurality of posable synthetic hair filaments each formed of a posable nonmetallic material being cold formable into a desired shape or set and tending to retain the desired shape or set when released.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
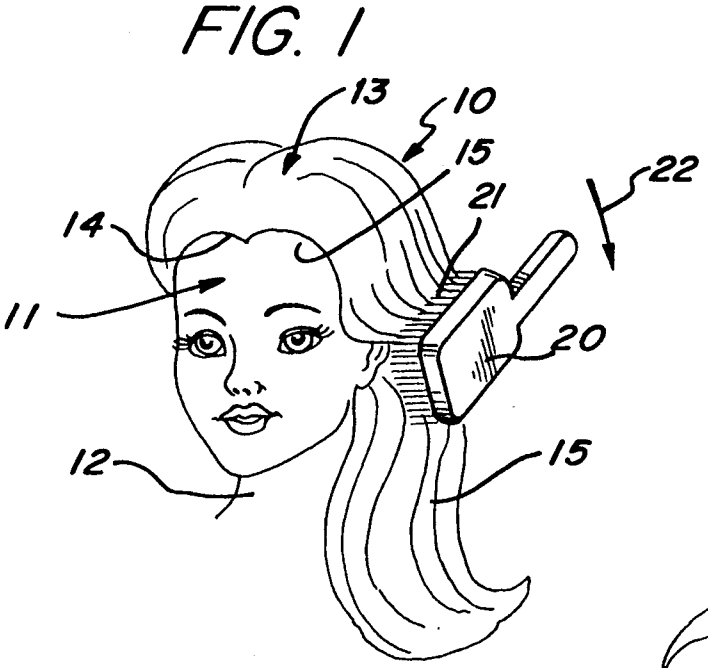
FIG. 1 sets forth a typical doll head having the present invention posable hair rooted thereon in a typical brushing or comb-out process.
Figure 5:
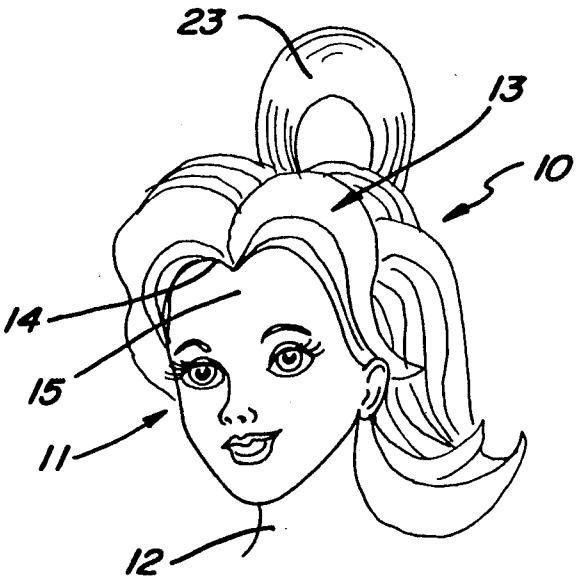
FIG. 5 sets forth an exemplary hairstyle completed for the present invention posable hair on a typical doll.

FIG. 1 sets forth a perspective view of a doll having posable hair constructed in accordance with the present invention and generally referenced by numeral 10. Doll 10 includes a head 11 which, in accordance with conventional fabrication techniques, defines the typical features of a doll and which is generally formed of a molded plastic or foam material or the like. Head 11 further includes a neck 12 which, in accordance with general fabrication techniques, is coupled to a conventional doll body (not shown). Head 11 further includes an outer skin 15 which is, in its preferred form, colored and textured to resemble human skin. In accordance with the present invention, a quantity of hair 13, fabricated in the manner set forth below in greater detail, is rooted to head 11 using conventional hair rooting techniques and producing a hair line 14 along head 11 which defines the boundary of hair 11. Hair 13 may be formed entirely of the present invention posable hair or may include conventional hair filaments dispersed therethrough. Further, as is seen in FIG. 5, a collection of posable hair filaments may be grouped to form a posable pony tail or similar styling.

In the operation set forth in FIG. 1 and in accordance with the present invention, hair 13 may be readily straightened or combed out using a conventional brush 20 having a plurality of hair bristles 21. In a typical use of the present invention posable hair, brush 20 may be embedded into a plurality or multiple strand segment of hair 13 partially separating it from the remainder of the hair on doll 10 and drawing brush 20 downwardly in the direction indicated by arrow 22. This process may be carried on repeatedly in a more or less typical hair brushing fashion by the child user. In accordance with an important advantage of the present invention described below in greater detail, the cold set or posable characteristic of hair 13 readily accepts the brushing action of brush 20 and readily parts and flows about bristles 21. In addition, the combing action and straightening force applied to the present invention posable hair by pulling brush 20 in the direction of arrow 22 readily straightens hair 13 and removes any of the previously imposed styling operations such as those set forth below in greater detail. Thus, after a period of time, the present invention posable hair assumes a casual generally straightened appearance such as that shown in FIG. 1.

Figure 2:
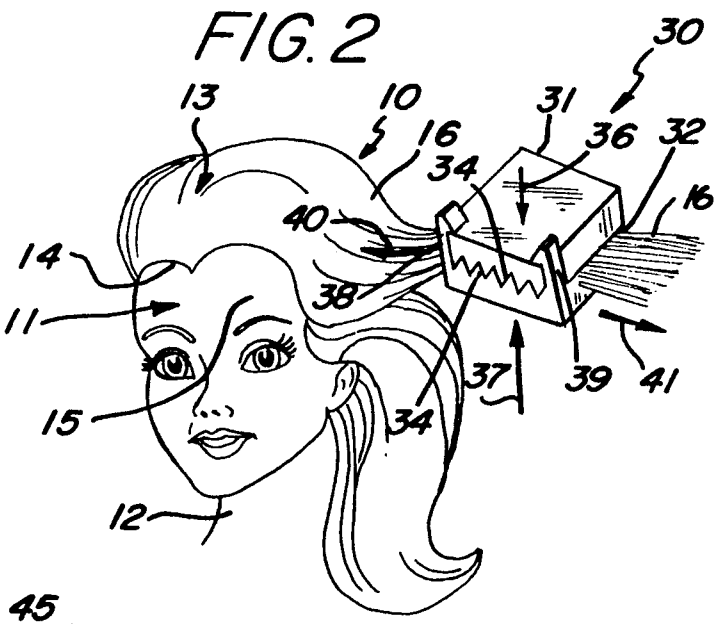
FIG. 2 sets forth an exemplary hair crimping operation being performed on a portion of the present invention doll hair.

FIG. 2 sets forth a perspective view of the doll of FIG. 1 showing a typical hairstyling operation. Specifically, doll 10 includes a head 11 having a neck 12 and supporting skin 15. As mentioned above, a quantity of posable hair constructed in accordance with the present invention 13 is rooted to skin 15 of doll head 11 in accordance with a conventional rooting operation. In the styling operation shown in FIG. 2, a segment of hair 13 generally referenced by numeral 16 and including a multiple number of hair strands has been separated from the remainder of hair 13 and drawn outwardly. Hair segment 16 has been placed within a crimping dye 13 which should be understood to be representative of any number of hairstyling devices which may be applied to the present invention posable hair. Accordingly, crimping dye 20 is formed of a pair of jaw portions 31 and 32 coupled in a pivotal attachment along a hinge 33. In the particular example shown in FIG. 2, jaws 31 and 32 each define a plurality of corrugations or serrations 34 and 35 respectively which, in their preferred form, mate or nest with their respective opposite jaw members. Thus, in the operation shown in FIG. 2, hair segment 16 has been placed between jaw portions 31 and 32 and thereafter jaws 31 and 32 have been closed in the directions indicated by arrows 36 and 37 to captivate hair segment 16 and force the multiple strands thereof to assume the corrugations of the mating jaws. Conventional latch apparatus such as flexible latches 38 and 39 are supported upon lower jaw 32 and engage and captivate jaw 31 in a closed position to maintain the crimping or setting action imposed upon hair segment 16.

In accordance with an important aspect of the present invention set forth below in greater detail, posable hair segment 16 may be set by a crimping dye such as dye 30 without the need to apply external heat or chemicals to cause hair segment 16 to assume a set or pose but rather posable hair segment 16 responds to the length of time which the hair segment is maintained within crimping dye 30. Thus, as is set forth below in greater detail, the degree to which the present invention posable hair retains the cold set for pose applied is determined largely by the time interval it spends in the posed or crimped position. In this case, the time interval of interest is the time period which hair segment 16 remains captivated within crimping dye 30. It has been found that many sets may be sufficiently imposed by utilizing setting periods in the order of one or two minutes. On the other hand, it has also been determined that substantially stronger hair sets may be imposed if the setting time is increased to five to ten minutes. In any event, once the desired crimp or styling set has been obtained, crimping dye 30 may be opened by simply springing latches 38 and 39 outwardly in the direction of arrows 40 and 41 respectively which freeze jaw 31 from jaw 32 and permits the removal of hair segment 16.

Figure 3:
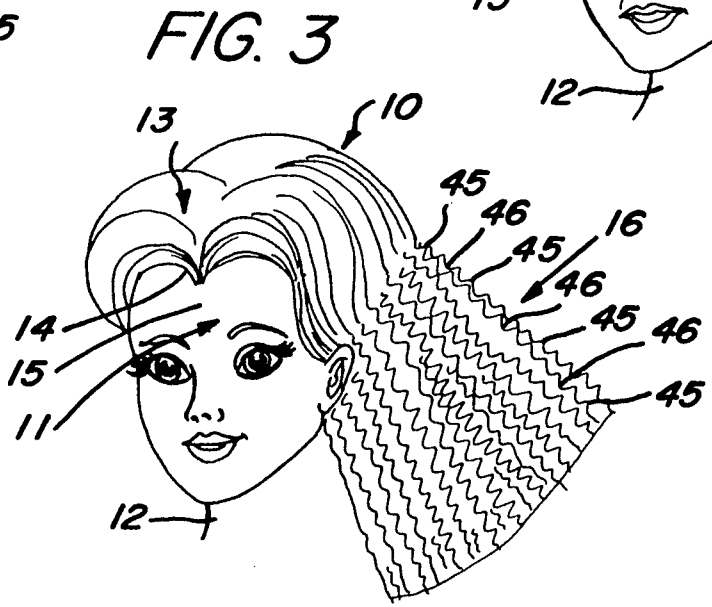
FIG. 3 sets forth an example of the completed crimping operation for the present invention doll hair.

FIG. 3 sets forth the doll of FIG. 1 and 2 having the present invention posable hair following the removal of crimping dye 30 from the operation in FIG. 2. Thus, as can be seen in FIG. 3, doll 10 having head 11 and neck 12 as described above and a quantity of posable hair 13 constructed in accordance with the present invention has received hair segment 16 following its release from crimping dye 30 (seen in FIG. 2). In general conformity to the corrugations and serrations of crimping dye 30 shown in FIG. 2, hair segment 16 now forms a collection of peaks or rolls 45 interleaved with valleys or lower portions 46. In accordance with the characteristics of posable hair 13 set forth below, peaks and valleys 45 and 46 tend to remain within hair 13. In a normal styling operation, of course, additional hair segments would be separated from the remainder of hair 13 and undergo similar crimping processes to crimp a substantial amount of hair 13. In accordance with an important aspect of the present invention, the repetition of the brushing process shown in FIG. 1 readily returns hair 13 to the generally straight configuration. This straightening process again is carried forward without the need for heat or setting gels of any kind.

Figure 4:
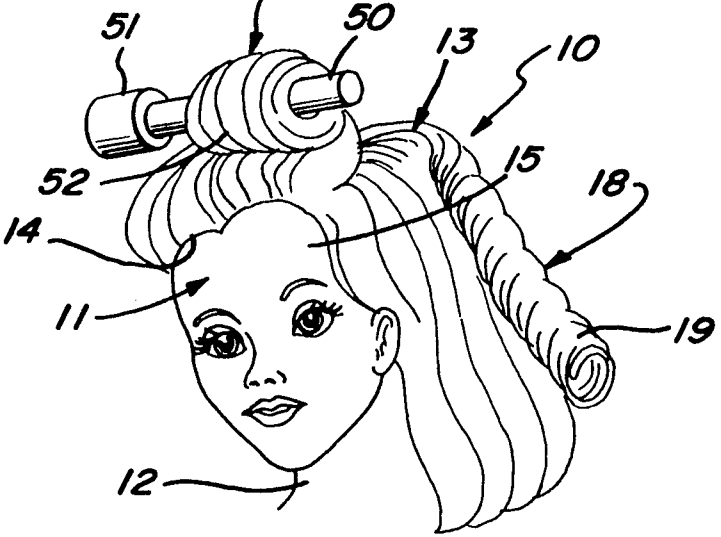
FIG. 4 sets forth an exemplary curling operation of the present invention doll hair.

FIG. 4 sets forth an alternative curling or hair setting operation from that shown in FIGS. 2 and 3 for the doll shown in FIGS. 1 through 3. As can be seen, a segment of hair 13 generally referenced by numeral 17 has been separated from the remainder of hair 13 and wound upon a generally cylindrical curling rod 50 having a handle 51. Segment 15 is then rolled to form a generally cylindrical curl 52. Once again, the degree of curling action is largely dependent upon the time period that hair segment 17 remains curled upon rod 50. In the normally anticipated play pattern, the child user would most likely maintain curl 17 upon rod 50 for a period of one to five minutes. Thereafter, curling rod 50 may be removed from hair segment 17 allowing curl 52 to fall under the influence of gravity. FIG. 4 also shows an additional hair segment 18 which has been subjected to the curling process being applied to hair segment 17. As can be seen, hair segment 18 now forms a group of loose generally spiralled curls 19 which have returned to the remainder of hair 13.

FIG. 5 sets forth a typical hairstyle for the present invention posable hair following the application of multiple cold set curls using the technique of FIG. 4. It will be apparent to those skilled in the art that any number of setting patterns and hairstyles may be applied to hair 13 without departing from the spirit and scope of the present invention. As mentioned above, hair 13 may be either entirely composed of the present invention posable hair or may include filaments of conventional hair mixed therein. Also, a quantity of posable hair with or without conventional hair may be grouped to form a pony tail 23 or other style element. In accordance with an important aspect of the present invention, posable hair 13 may be returned from the set shown in FIG. 5 to a straight hairdo such as that shown in FIG. 1 by simply combing or brushing hair 13 in a typical manner.

The present invention posable hair utilizes an amorphous thermoplastic material having a glass transition temperature within the range of zero degrees Centigrade to twenty degrees Centigrade and having a hardness measured at seventy two degrees Fahrenheit of approximately eighty five Shore A Durometer to ninety eight Shore A Durometer. In its preferred form, the amorphous thermoplastic materials selected are similar to molding and extrusion type compounds which provide good heat stability and elongation of fifty percent to four hundred percent while providing a tenacity of fiber of a least one gram per denier. It has been determined that the present invention posable hair readily achieves a crimp curl or other configuration without the need for excessive crimping or deforming force being applied. Instead, the present invention posable hair exhibits a characteristic within which the time interval overwhich the hair is crimped, curled or otherwise configured becomes the important factor in determining the strength of cold set applied. Because of the use of an amorphous thermoplastic material having the combination of glass temperature and hardness set forth above, excessive stresses upon the posable hair filaments are not required due to the tendency of the polymer molecule within the amorphous thermoplastic to rotate or relax or in some cases orient to the new configuration. Thus, no stretching, necking down, or other abuse of the fiber was evident after repeated cycling in excess of one thousand cycles of orientation.

The present invention posable hair may be fabricated using amorphous thermoplastic materials such as polyvinyl chloride, compounds similar to those used in molding and extrusion operations as well as polyvinylidene chloride compounds or copolymers thereof combined with plasticizers, lubricants, heat stabilizers, fillers and colorants. Also blends of polyvinyl chloride and polyvinylidene chloride and their copolymers such as polyvinyl acetate and acrylonitrile.

While a number of amorphous thermoplastic materials may be used, it has been found generally that those having higher molecular weights exhibit preferred physical properties and are thus preferred compounds for doll hair in accordance with the present invention. It has been found that the following compound proportionate parts have exhibited substantial advantage for the present invention posable hair:

| | |
|---|---|
| High molecular weight polymer (or copolymer) of polyvinyl chloride or polyvinylidene chloride | 100 parts |
| Plasticizer | 40 parts |
| Heat Stabilizer | 7 parts |
| Lubricant | 1 part |

In addition, coloring materials, anti-static agents and fillers may be used sparingly as required.

What has been shown is a new and improved doll having posable hair which permits the use of cold setting and crimping apparatus and which provides a long lasting set or curl in a synthetic doll's hair. The posable hair may be repeatedly combed out and reset without tangling, matting, or splitting while maintaining excellent appearance and continued use. The hair may be formed using a variety of readily available amorphous thermoplastic materials by establishing the glass transition temperature and hardness relationship therein to provide the present invention posable properties.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A posable hair doll comprising:

a doll head having a hair-supporting portion thereon; and a plurality of posable synthetic hair filaments each formed of a posable nonmetallic material being cold formable into a desired shape or set and tending to retain said desired shape or set when released and being restorable to their previous shape by heatless brushing or combing, said synthetic hair filaments being formed of an amorphous thermoplastic material having a glass transition temperature between zero degrees centigrade and plus twenty degrees centigrade and a hardness between eighty and one hundred Shore A Durometer.

2. A posable hair doll as set forth in claim 1 wherein said amorphous thermoplastic defines a high molecular weight characteristic.

3. A posable hair doll as set forth in claim 2 further including a plurality of non-posable synthetic hair filaments interspersed throughout said posable synthetic hair filaments.

4. A posable hair doll as set forth in claim 3 wherein said posable synthetic hair filaments and said nonposable synthetic hair filaments are generally equally distributed upon said doll head.

5. A posable hair doll as set forth in claim 3 wherein at least some of said posable synthetic hair filaments are grouped to form a posable pony tail.

6. For use in combination with a doll, a plurality of hair filaments formed of a material comprising a compound of not less than 60% nor more than 75% by weight of a high molecular weight polymer or copolymer of polyvinyl chloride; and not less than 20% nor more than 35% by weight of a plasticizer; and not less than 3% nor more than 10% by weight of a heat stabilizer; and not less than 0.5% nor more than 1.5% by weight of a lubricant.

7. For use in combination with a doll, a plurality of hair filaments formed of a material comprising a compound of not less than 60% nor more than 75% by weight of a high molecular weight polymer or copolymer of polyvinylidene chloride; and not less than 20% nor more than 35% by weight of a plasticizer; and not less than 3% nor more than 10% by weight of a heat stabilizer; and not less than 0.5% nor more than 1.5% by weight of a lubricant.

* * * * *